US006072979A

United States Patent [19]

Hiroaka

[11] Patent Number: 6,072,979

[45] Date of Patent: Jun. 6, 2000

[54] THERMAL ROLLER OF FUSER

[75] Inventor: Yuji Hiroaka, Hsinchu, Taiwan

[73] Assignee: Aetas Technology Corporation, Torrance, Calif.

[21] Appl. No.: 08/982,486

[22] Filed: Dec. 2, 1997

Related U.S. Application Data

[60] Provisional application No. 60/032,074, Dec. 2, 1996.

[51] Int. Cl.[7] ..... G03G 15/01; H05B 1/00

[52] U.S. Cl. ..... 399/330; 219/216

[58] Field of Search ..... 399/320, 328, 399/330, 331, 332, 333, 334; 118/60; 219/216, 469, 470, 471

[56] References Cited

U.S. PATENT DOCUMENTS 4,109,135 8/1978 Minden et al. ..... 219/216

5,420,395 5/1995 Hyllberg et al. ..... 219/470

5,575,942 11/1996 Watanabe ..... 219/469

*Primary Examiner*—Arthur T. Grimley

*Assistant Examiner*—Hoan Tran

*Attorney, Agent, or Firm*—Baker & Botts, LLP

[57] ABSTRACT

The present invention sets forth a thermal roller of a fuser for fixing a toner image onto a surface of a recording medium. The thermal roller includes a roller cylinder having an electric insulating layer attached to an inner wall of the roller cylinder, an electric resistance wire helically wound on the electric insulating layer; and a power source provided at an end of the roller cylinder and electrically connected with the electric resistance wire for providing the electric resistance wire with power. The thermal roller according to the present invention can enhance power efficiency and reduce hazard of inflammation at low costs.

7 Claims, 3 Drawing Sheets

THERMAL ROLLER OF FUSER

PRIOR APPLICATIONS

This application claims the benefit of U.S. Provisional Application No. 60/032,074, filed Dec. 2, 1996.

FIELD OF THE INVENTION

The present invention relates to a thermal roller of a fuser. More particularly, the present invention relates to a fusing device for use in an electrophotographic apparatus.

DESCRIPTION OF THE RELATED ART

A fuser comprising a pressure roller and a thermal roller has been used to fix a toner image onto a surface of a recording medium. FIG. 1 shows a conventional fuser consisting of a thermal roller and a pressure roller. The thermal roller comprises a roller cylinder 10 having a halogen lamp 12 therein, and the pressure roller comprises a roller cylinder 16 on which an elastomer layer 14 is coated. A recording medium 18 (e.g., a sheet of paper or transparency) carrying toner 20 passes through the fuser, and is heated and pressed at the same time. After that, the toner image is fixed onto a surface of the recording medium 18.

However, the above-mentioned fuser has a disadvantage in that the heat loss thereof is considerable when heat is transferred from the halogen lamp 12 to the roller cylinder 10 by means of radiation due to absorption loss of radiation and leakage of heated air. It is difficult to increase the efficiency level of the heat source (halogen lamp) up to more than 70%, and therefore it is difficult to lower the power consumption.

Further, in such a heat source of radiation type, the temperature thereof must exceed 900° C., which is close to the inflammation temperature of an organic material such as paper. It would be dangerous to apply the heat source to devices used in regular office environments.

SUMMARY OF THE INVENTION

It is therefore an object of the present invention to provide a thermal roller of a fuser having a high efficiency.

Another object of the present invention is to provide a thermal roller of a fuser with no hazard.

A further object of the present invention is to provide a thermal roller of a fuser of low cost.

To achieve the above objects, according to the present invention, an electric resistance wire is helically wound on an inner wall of a thermal roller and an electric insulating layer is provided therebetween. Such a structure enables reduction of the heat loss and lowering of the heat source temperature with materials of low costs.

These and other objects, features and advantages of the present invention will become appearance to those skilled in the art upon consideration of the following description of the preferred embodiment of the present invention taken in conjunction with the accompanying drawings.

DETAILED DESCRIPTION OF THE PREFERRED EMBODIMENT

The following description will be made to the preferred embodiment of the present invention with reference to the accompanying drawings.

Figure 1:
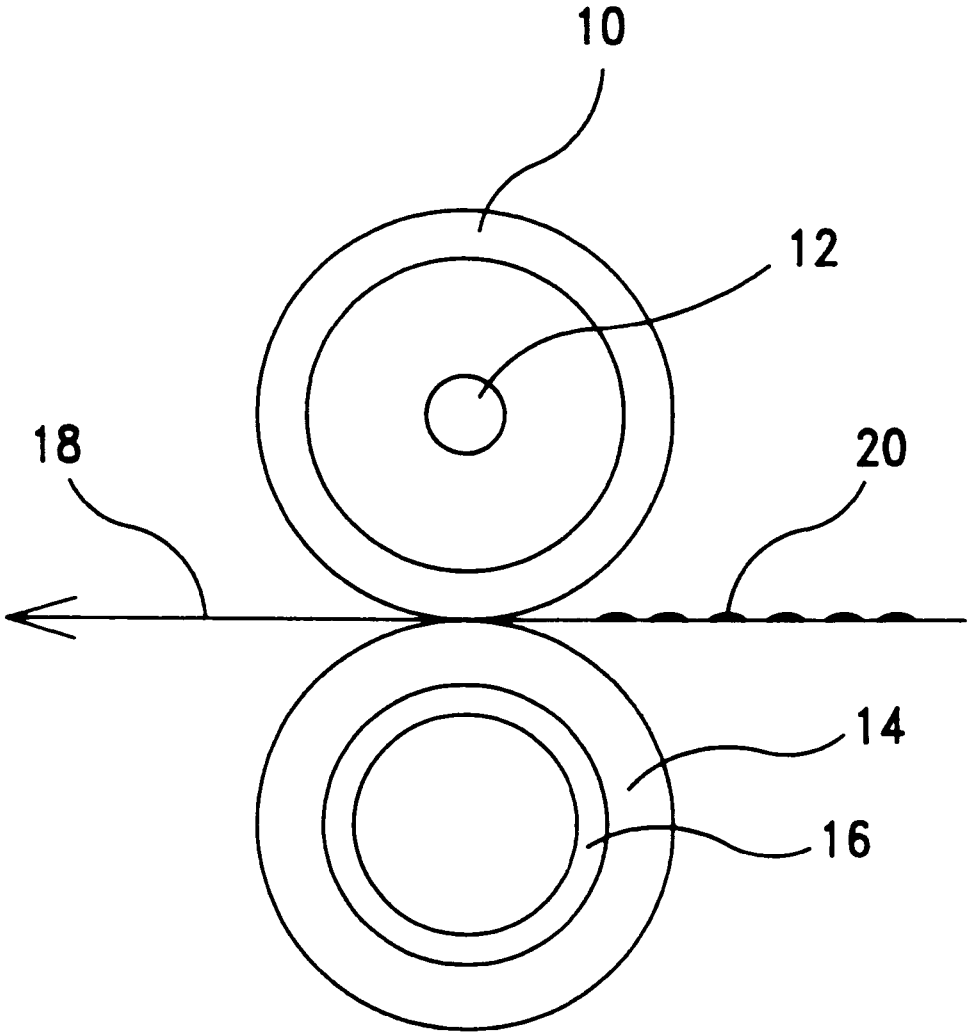
FIG. 1 PRIOR ART
FIG. 1 shows a structure of a conventional fuser.
Figure 2:
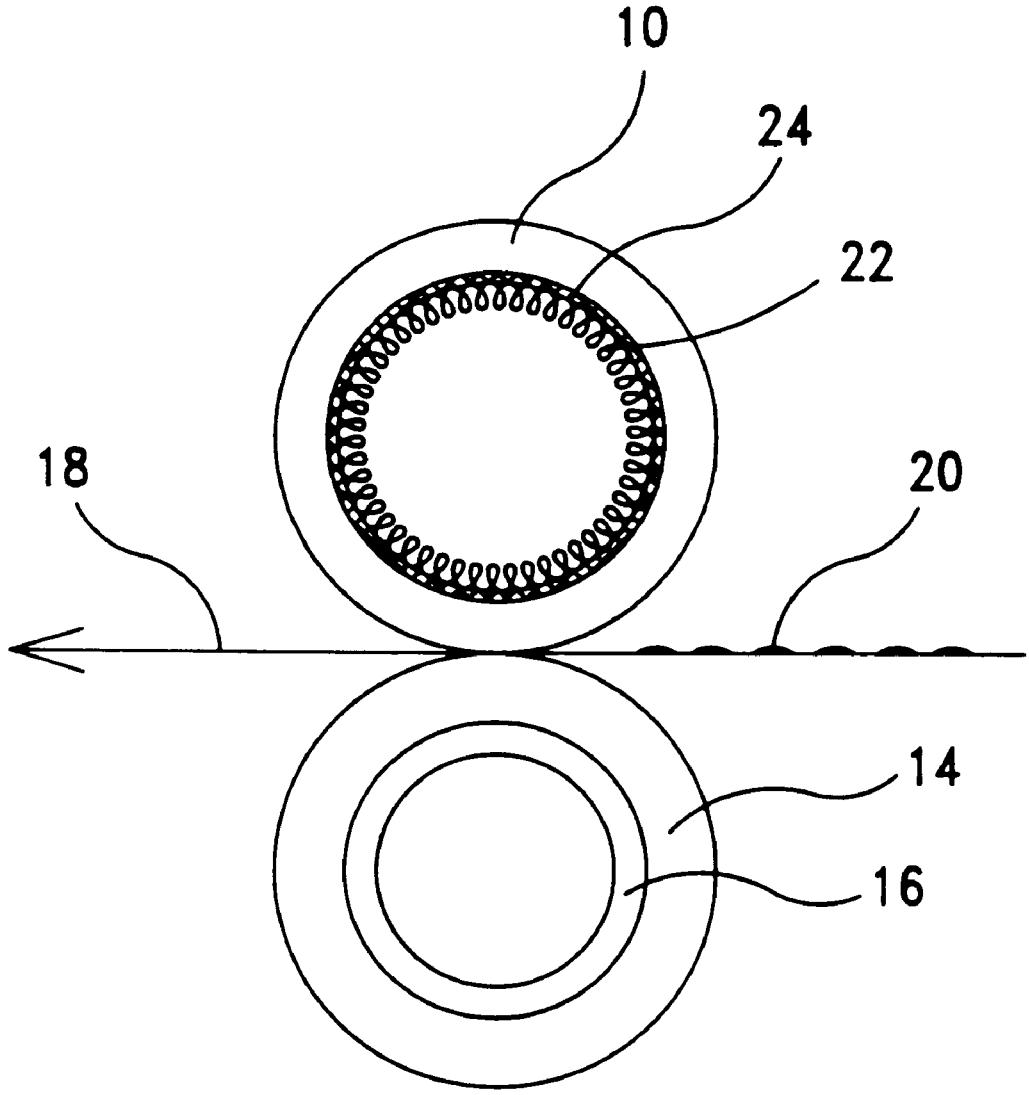
FIGS. 2 and 3 show a thermal roller of a fuser according to an embodiment of the present invention.

FIG. 2 shows a structure of a heat source according to the preferred embodiment of the present invention. In FIG. 2, an electric resistance wire 22 for supplying heat energy is provided with a roller cylinder 10, and an electric insulating layer 24 for isolation is provided therebetween. An elastomer layer 14 and a roller cylinder 16 which are the same as those shown in FIG. 1 are also illustrated, and their operation is identical to that described with reference to FIG. 1. After fusing process, toner 20 on a recording medium 18 is fixed onto the recording medium 18 to form a desired image.

The roller cylinder 10 has a rigid outer surface and a high thermal conductivity. The electric insulating layer 24 also has a high thermal conductivity and is heat-proof, and it is tightly contacted with an inner surface of the roller cylinder 10. An electric resistance wire 22 is fixed to the electric insulating layer 24 by a bonding agent, for example, a liquid ceramic.

The roller cylinder 10 is preferably made of aluminum due to its excellent hardness and thermal conductivity. The inner surface of the roller cylinder 10 is formed with an alumina layer serving as the electric insulating layer 24. The electric resistance wire 22 is preferably formed from nickel-chrome alloy having a volume resistivity of about $10^{-3}$ Ω mm.

Figure 3:
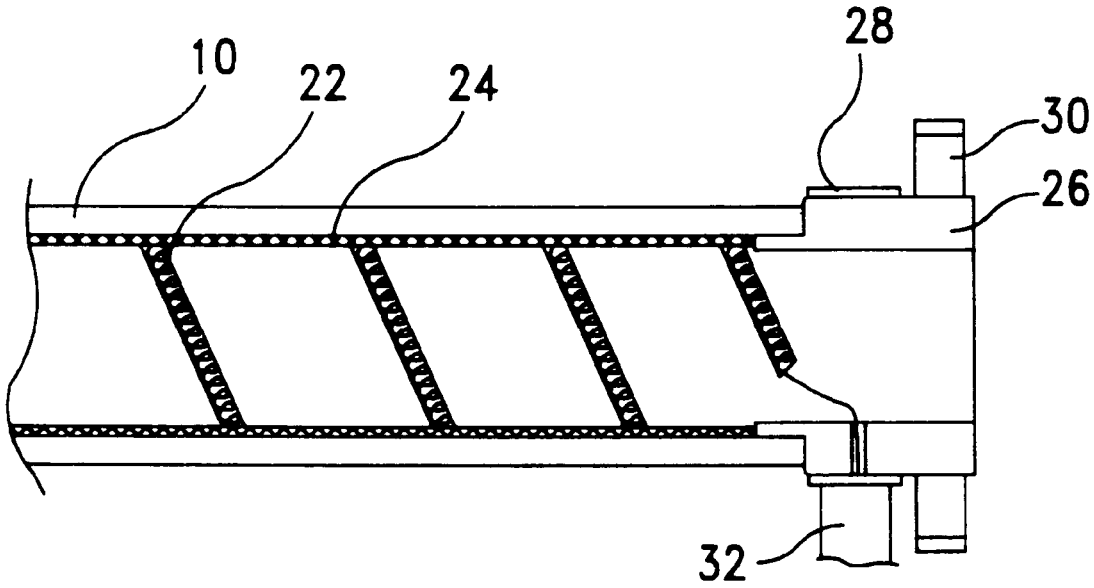

FIG. 3 is a cross-sectional view showing the thermal roller according to the preferred embodiment. The electric resistance wire 22 is helically wound to increase the heat density. In addition, the electric resistance wire 22 is helically extended in the length direction of the roller cylinder 10 along the inner surface thereof. Further, a terminal 26 for supporting a power supply ring 28 and a driving gear 30 is provided at an end of the roller cylinder 10. The power supply ring 28 is electrically connected with the electric resistance wire 22. A power spring 32 for feeding power from an external power supply is pressed against the power supply ring 28.

Since the electric resistance wire 22 is adjacent to the inner wall of the roller cylinder 10, the heat generated by the electric resistance wire 22 can be directly transferred to the roller cylinder 10. Therefore, the heat loss can be greatly reduced and the efficiency level can be increased up to more than 90%. Further, the temperature of the electric resistance wire 22 is approximately the same as the surface temperature of the roller cylinder 10, and thus the thermal roller according to the present invention is much less hazardous. Also, since it is easy to mass-produce the thermal roller of the present invention using inexpensive materials, the manufacturing cost according to the present invention is much lower than that of a conventional thermal roller.

While the present invention has been described with respect to what is presently considered to be preferred embodiment, it is obvious that various variations and modifications may be made in the invention without departing from the spirit and scope thereof as set forth in the appended claims.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A thermal roller of a fuser for fixing a toner image onto a surface of a recording medium, comprising:

a hollow roller cylinder having a rigid outer surface and a high thermal conductivity, a heat-proof electric insulating layer having a high thermal conductivity being uniformly attached to an inner wall of the roller cylinder;

a flexible electric resistance wire for providing the roller cylinder with heat, the electric resistance wire being helically wound and extending in a helical path along the inner surface of the electric insulating layer and attached to the electric insulating layer by a bonding agent; and a power source provided at an end of the roller cylinder and electrically connected with the electric resistance wire for providing the electric resistance wire with power.

2. The thermal roller according to claim 1, wherein the roller cylinder is made of aluminum.

3. The thermal roller according to claim 2, wherein the electric insulating layer is made of alumina.

4. The thermal roller according to claim 1, wherein the bonding agent comprises a liquid ceramic.

5. The thermal roller according to claim 1, wherein the electric resistance wire is made of nickel-chrome alloy.

6. The thermal roller according to claim 1, wherein the electric resistance wire has a volume resistivity of about $10^{-3}$ Ω mm.

7. The thermal roller according to claim 1, wherein the power source comprises a power supply ring engaged with a terminal provided at an end of the roller cylinder, and a power spring pressed against the power supply ring for providing the power supply ring with power.

* * * * *